US012559339B2

(12) United States Patent
Takano et al.

(10) Patent No.: US 12,559,339 B2
(45) Date of Patent: Feb. 24, 2026

(54) SHEET POST-PROCESSING APPARATUS WITH PAIR OF SIDE END CURSORS PIVOTABLE TOWARD AND AWAY FROM TRAY AND MOVABLE IN SHEET WIDTH DIRECTION, AND IMAGE FORMATION SYSTEM WITH SHEET POST-PROCESSING APPARATUS

(71) Applicant: KYOCERA Document Solutions Inc., Osaka (JP)

(72) Inventors: Yusuke Takano, Osaka (JP); Keisuke Egawa, Osaka (JP); Yasunori Ueno, Osaka (JP); Seiichi Shirasaki, Osaka (JP); Terumitsu Noso, Osaka (JP); Takuya Nishimura, Osaka (JP); Takehiko Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 199 days.

(21) Appl. No.: 18/418,746

(22) Filed: Jan. 22, 2024

(65) Prior Publication Data

US 2024/0253936 A1 Aug. 1, 2024

(30) Foreign Application Priority Data

Jan. 30, 2023 (JP) ..... 2023-012220

(51) Int. Cl.
*B65H 29/34* (2006.01)
*B65H 31/34* (2006.01)

(52) U.S. Cl.
CPC ..... *B65H 31/34* (2013.01); *B65H 2404/732* (2013.01); *B65H 2404/733* (2013.01)

(58) Field of Classification Search
CPC ..... B65H 29/34; B65H 29/46; B65H 31/30; B65H 31/3009; B65H 31/3018;
(Continued)

(56) References Cited

U.S. PATENT DOCUMENTS 6,871,851 B2 * 3/2005 Tamura ..... B65H 33/08 271/220
8,136,807 B2 * 3/2012 Uchiyama ..... B65H 31/10 270/58.11

(Continued)

FOREIGN PATENT DOCUMENTS

JP 2015113200 A 6/2015
JP 2018080044 A 5/2018

*Primary Examiner* — Leslie A Nicholson, III
(74) *Attorney, Agent, or Firm* — IP Business Solutions, LLC

(57) ABSTRACT

A sheet post-processing apparatus successively performs: a control in a first mode to move a pair of side end cursors to respective first positions where edges of the side end cursors facing a tray come into contact with an ejected sheet above and away from the tray and move the side end cursors to respective holding positions located inwardly of the sheet in a width direction; and a control in a second mode to move the side end cursors to respective lateral positions located outwardly of the sheet in the width direction, move the side end cursors to respective second positions where the edges of the side end cursors facing the tray come close to or into contact with the tray, and move the side end cursors from the lateral positions to respective abutment positions where the side end cursors abut against ends of the sheet in the width direction.

6 Claims, 12 Drawing Sheets

(58) Field of Classification Search
CPC ..... B65H 31/34; B65H 2404/732; B65H 2404/733; B65H 2301/3613; B65H 2301/36112; B65H 2301/363
USPC ..... 270/58.12, 58.17, 58.27
See application file for complete search history.

(56) References Cited

U.S. PATENT DOCUMENTS

| | | | | |
|---|---|---|---|---|
| 8,177,227 | B2 * | 5/2012 | Uchiyama | B65H 31/10 271/226 |
| 8,326,208 | B2 * | 12/2012 | Tamura | B65H 29/14 399/407 |
| 8,651,480 | B2 * | 2/2014 | Watanabe | B65H 31/38 271/221 |
| 10,351,383 | B2 * | 7/2019 | Saito | B65H 31/36 |
| 10,604,372 | B2 * | 3/2020 | Ohata | B65H 31/38 |
| 11,485,601 | B2 * | 11/2022 | Egawa | B65H 33/08 |

* cited by examiner

SHEET POST-PROCESSING APPARATUS WITH PAIR OF SIDE END CURSORS PIVOTABLE TOWARD AND AWAY FROM TRAY AND MOVABLE IN SHEET WIDTH DIRECTION, AND IMAGE FORMATION SYSTEM WITH SHEET POST-PROCESSING APPARATUS

INCORPORATION BY REFERENCE

This application claims priority to Japanese Patent Application No. 2023-012220 filed on 30 Jan. 2023, the entire contents of which are incorporated by reference herein.

BACKGROUND

The present disclosure relates to sheet post-processing apparatuses and image formation systems capable of loading a plurality of sheets on a tray and processing them on the tray and particularly relates to a technique for loading each of the sheets on the tray and aligning it with the other sheets.

In an image forming apparatus, an image reading device reads an image of an original document and an image forming device forms the image of the original document on a recording paper sheet (a sheet). A sheet post-processing apparatus receives the recording paper sheet with the image of the original document formed thereon from the image forming apparatus and ejects the recording paper sheet to the tray after or without subjecting the recording paper sheet to post-processing.

There is generally known a sheet loading device including a pair of jogger fences provided above a tray to align sheets, which have been ejected by a sheet ejection roller, in a width direction of the sheets. This sheet loading device allows the pair of jogger fences to move, from their respective ready positions where the jogger fences stay with a larger distance than the sheet width left between them, toward each other in the sheet width direction to align the sheets in the sheet width direction. This sheet loading device further includes an uplift restricting member provided above the tray. This sheet loading device restricts, with the above uplift restricting member, the uplift of the leading end of a sheet ejected by the sheet ejection roller.

There is also known a post-processing device that allows a pair of alignment members to move between a first position and a second position both located along the sheet width direction. This post-processing device is configured so that when the pair of alignment members move to the first position, they abut against the side edges of a sheet ejected to a tray to restrict the position of the sheet, and, on the other hand, when the pair of alignment members move to the second position, they abut, from above, against a sheet ejected to the tray and rock on the sheet to correct a deflection of the sheet. In this post-processing device, the pair of alignment members are located selectively at the first position or the second position depending on situations of image formation where a sheet is likely to curl.

SUMMARY

A technique improved over the aforementioned techniques is proposed as one aspect of the present disclosure.

A sheet post-processing apparatus according to an aspect of the present disclosure includes a post-processing device, an ejection roller, a tray, a pair of side end cursors, a first drive device, a second drive device, and a control device. The post-processing device subjects a sheet to post-processing. The ejection roller ejects the sheet. The tray allows a plurality of sheets ejected by the ejection roller to be loaded thereon. The pair of side end cursors are provided above the tray and the ejection roller pivotably toward and away from the tray and opposed to each other in a width direction of the sheet orthogonal to a direction of ejection of the sheet movably in the width direction. The first drive device pivots each of the side end cursors toward and away from the tray. The second drive device moves each of the side end cursors in the width direction. The control device includes a processor and controls, through the processor executing a control program, the first drive device and the second drive device. The control device successively performs: a control in a first mode to allow the first drive device to pivot each of the side end cursors away from the tray to thus move the side end cursors to respective predetermined first positions where edges of the side end cursors facing the tray are located above and away from the tray and come into contact with the sheet ejected by the ejection roller and allow the second drive device to move each of the side end cursors to respective holding positions located inwardly of the sheet in the width direction; and a control in a second mode to allow the second drive device to move each of the side end cursors in the width direction to respective predetermined lateral positions located outwardly of the sheet in the width direction, allow the first drive device to pivot each of the side end cursors toward the tray to thus move the side end cursors to respective predetermined second positions where the edges of the side end cursors facing the tray come close to or into contact with the tray, and then allow the second drive device to move each of the side end cursors from the lateral positions to respective predetermined abutment positions where the side end cursors abut against ends of the sheet in the width direction.

An image formation system according to another aspect of the present disclosure includes an image forming apparatus and the above-described sheet post-processing apparatus. The image forming apparatus includes an image forming device. The image forming device forms an image of an original document on a sheet. The sheet post-processing apparatus further includes a conveyance roller. The conveyance roller receives the sheet from the image forming apparatus and conveys the received sheet toward the post-processing device.

DETAILED DESCRIPTION

Figure 1:
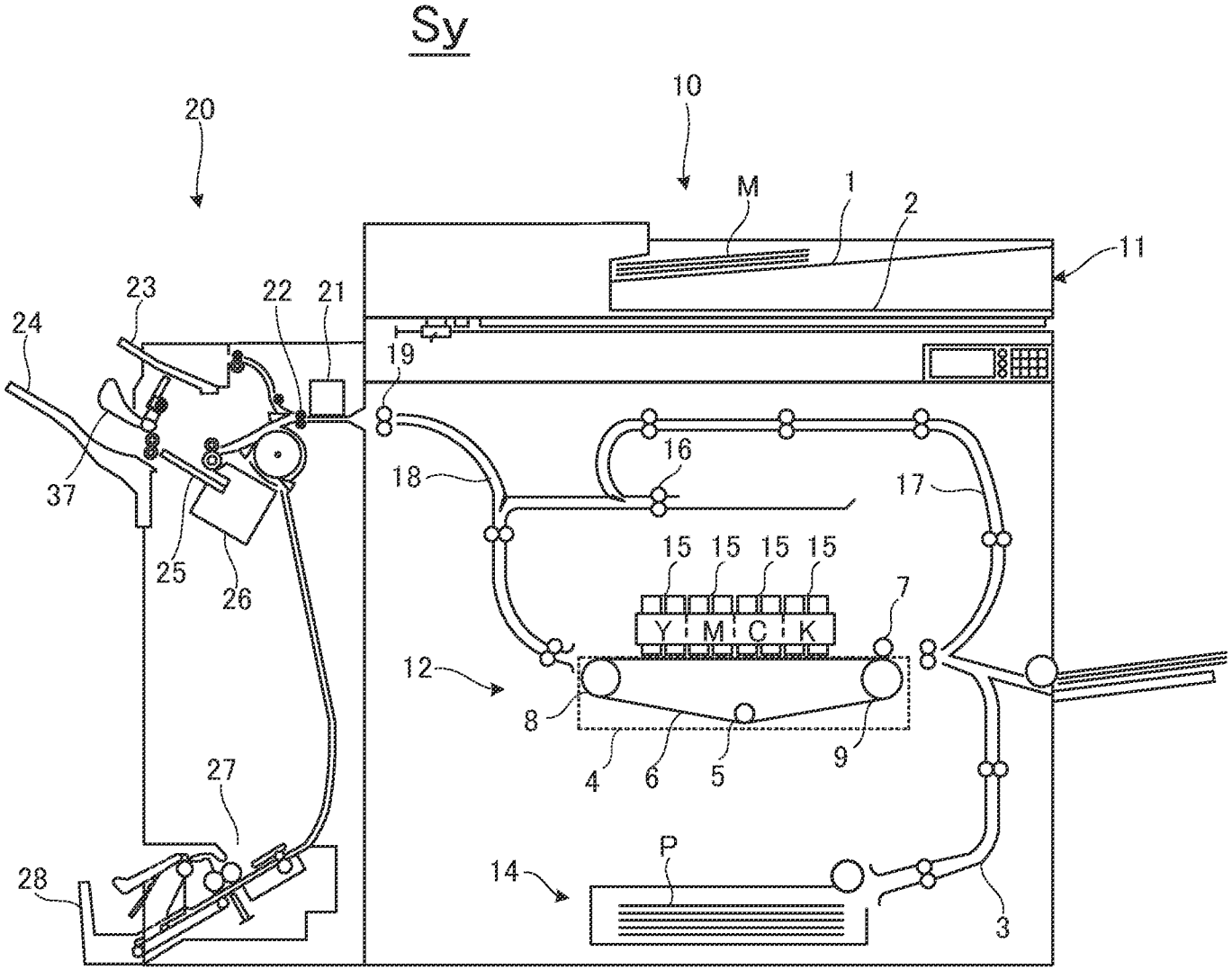
FIG. 1 is a cross-sectional view showing an image forming apparatus and a sheet post-processing apparatus in an image formation system according to an embodiment of the present disclosure.

Hereinafter, a description will be given of one embodiment of the present disclosure with reference to the drawings. FIG. 1 is a cross-sectional view showing an image forming apparatus 10 and a sheet post-processing apparatus 20 in an image formation system Sy according to the one embodiment of the present disclosure. The image formation system Sy includes: the image forming apparatus 10 that reads an image of an original document and forms the image on a recording paper sheet P; and the sheet post-processing apparatus 20 that receives the recording paper sheet P from the image forming apparatus 10 and subjects the recording paper sheet P to post-processing.

The image forming apparatus 10 includes an image reading device 11 and an image forming device 12. When a plurality of original document sheets M are placed on an original document tray 1, the image reading device 11 sequentially pulls out and conveys the plurality of original document sheets M sheet by sheet from the original document tray 1, reads an image of each original document sheet M with a pickup device while conveying the original document sheet M, and sequentially ejects the read original document sheets M to an ejection tray 2 to lay them one on top of another on the ejection tray 2. The image reading device 11 converts, for each of the images of original document sheets M, an analog output of the pickup device to a digital signal to generate image data representing the image of the original document sheet M.

Each time image data representing each of the images of the plurality of original document sheets M is sequentially input to the image forming device 12, the image forming device 12 forms the image of the original document sheet M represented by the image data on a recording paper sheet (a sheet) P using an ink-jet system. The image forming device 12 includes respective line heads (examples of ink heads) 15 that discharge ink drops of four colors (black, cyan, magenta, and yellow). The line heads 15 discharge ink drops of the individual colors onto the recording paper sheet P being conveyed from a sheet feed device 14 via a first conveyance path 3 to a conveyance unit 4, thus forming a multicolor image on the recording paper sheet P.

The conveyance unit 4 includes a drive roller 8, a driven roller 9, a tension roller 5, and a conveying belt 6. The conveying belt 6 is an endless belt and is mounted around the drive roller 8, the driven roller 9, and the tension roller 5. The drive roller 8 is driven into counterclockwise rotation by a motor. When the drive roller 8 is driven into rotation, the conveying belt 6 travels around the above rollers counterclockwise and the driven roller 9 and the tension roller 5 rotate counterclockwise by following the travel of the conveying belt 6 engaged on them.

The tension roller 5 appropriately holds the tension of the conveying belt 6. An adsorption roller 7 is in contact with the conveying belt 6. The adsorption roller 7 electrically charges the conveying belt 6 to electrostatically adsorb on the conveying belt 6 a recording paper sheet P being fed from the sheet feed device 14.

When the image forming device 12 forms the image of each original document sheet M on a recording paper sheet P, the image forming apparatus 10 allows the recording paper sheet P to be conveyed via an intermediate conveyance path 18 to the sheet post-processing apparatus 20 by a conveyance roller 19.

In further recording an image of the original document sheet M on the back side of the recording paper sheet P, the image forming apparatus 10 performs switchback conveyance of the recording paper sheet P, in which the recording paper sheet P is conveyed from the intermediate conveyance path 18 to a conveyance roller 16 and the conveyance roller 16 is stopped and then reversely rotated. After the switchback conveyance, the image forming apparatus 10 returns the recording paper sheet P via a second conveyance path 17 to the conveyance unit 4, thus turning over the recording paper sheet P. When the image forming device 12 forms the image of the original document sheet M on the back side of the recording paper sheet P, the image forming apparatus 10 allows the recording paper sheet P to be conveyed via the intermediate conveyance path 18 to the sheet post-processing apparatus 20 by the conveyance roller 19.

The sheet post-processing apparatus 20 includes a punching device 21, a conveyance roller 22, a sub-tray 23, a main tray 24, a processing tray 25, a stapling device 28 (an example of the post-processing device), a saddle stitching device 27, an output tray 28, and so on. The punching device 21 punches a recording paper sheet conveyed by the conveyance roller 19. The conveyance roller 22 conveys the recording paper sheet P. The sub-tray 23 and the main tray 24 receive the recording paper sheet P ejected thereto.

The processing tray 25 allows a plurality of recording paper sheets P to be temporarily loaded thereon. The stapling device 26 staples together the plurality of recording paper sheets P loaded on the processing tray 25. The saddle stitching device 27 saddle-stitches and folds the plurality of recording paper sheets P together in the middle. The output tray 28 receives the plurality of folded recording paper sheets P ejected thereto.

Figure 2:
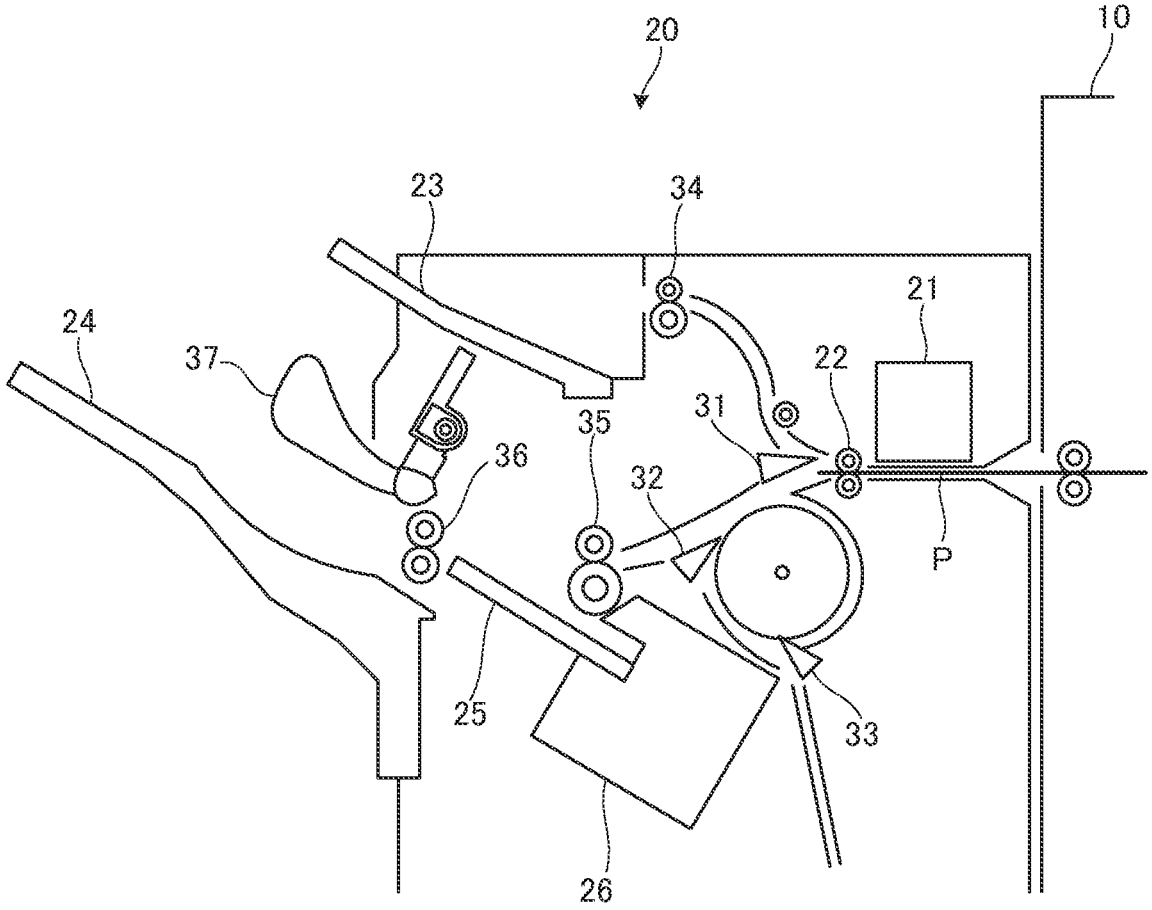
FIG. 2 is a cross-sectional view showing an upper portion of the sheet post-processing apparatus in magnification.

FIG. 2 is a cross-sectional view showing an upper portion of the sheet post-processing apparatus 20 in magnification. As shown in FIG. 2, the sheet post-processing apparatus 20 includes a plurality of diverting fingers 31, 32, and 33. By changeover of the positions of these diverting fingers 31, 32, and 33, the recording paper sheet P is led from the conveyance roller 22 to an ejection roller 34 located above the conveyance roller 22 and ejected to the sub-tray 23, or the recording paper sheet P is led from the conveyance roller 22 to the saddle stitching device 27 (see FIG. 1) located below the conveyance roller 22, or the recording paper sheet P is led from the conveyance roller 22 to a relay roller 35.

When the recording paper sheet P is led to the relay roller 35, the relay roller 35 conveys the recording paper sheet P to an ejection roller 36. The ejection roller 36 temporarily stops and reversely rotates, thus ejecting the recording paper sheet P to the processing tray 25. When a plurality of recording paper sheets P are sequentially ejected to and loaded on the processing tray 25, the stapling device 26 staples together the plurality of recording paper sheets P on the processing tray 25. The recording paper sheets P stapled together are ejected through the ejection roller 36 to the main tray 24.

Alternatively, when the recording paper sheet P is led to the relay roller 35, the relay roller 35 conveys the recording paper sheet P to the ejection roller 36. The ejection roller 36 ejects the recording paper sheet P directly to the main tray 24.

In ejecting a plurality of recording paper sheets P directly to the main tray 24, it is preferred that the plurality of recording paper sheets P are stacked in alignment with each other on the main tray 24. To accomplish this, it is necessary to correct a curl or deflection of each recording paper sheet P, then eject it to the main tray 24, and align the plurality of recording paper sheets P loaded on the main tray 24.

In this embodiment, a pair of side end cursors 37 are provided above the main tray 24. The pair of side end cursors 37 are opposed to each other in a direction orthogonal to a direction of ejection of a recording paper sheet P, i.e., in a width direction of a recording paper sheet P to be ejected. The pair of side end cursors 37 each have a flat plate-like shape and extend to project outward from the main body of the sheet post-processing apparatus 20.

The pair of side end cursors 37 are provided facing their flat surfaces in the width direction of the recording paper sheet P. The pair of side end cursors 37 are pivotable toward and away from the main tray 24 (in an up-and-down direction in FIG. 2). The pair of side end cursors 37 are mounted at respective ends thereof in the direction of ejection to respective pins extending in the width direction, supported by the pins, and are pivotable around the respective axes of the pins. Furthermore, the pair of side end cursors 37 are capable of sliding movement toward and away from each other in the width direction.

Figure 3A:
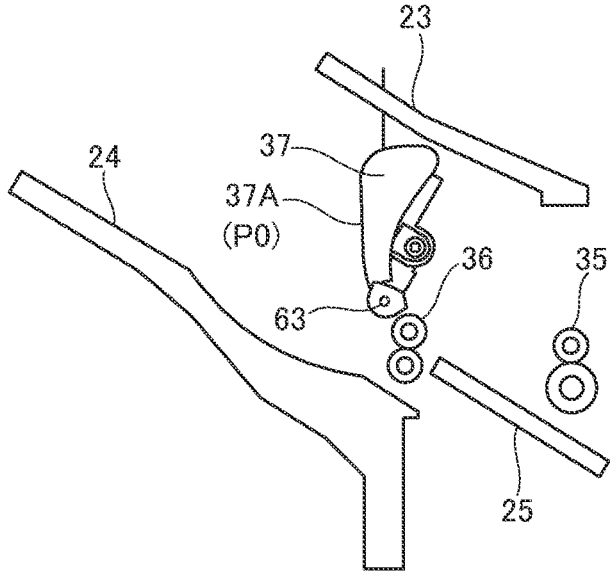
FIGS. 3A to 3C are side views showing pivoting poses of each side end cursor in a direction toward and away from a main tray.
Figure 3B:
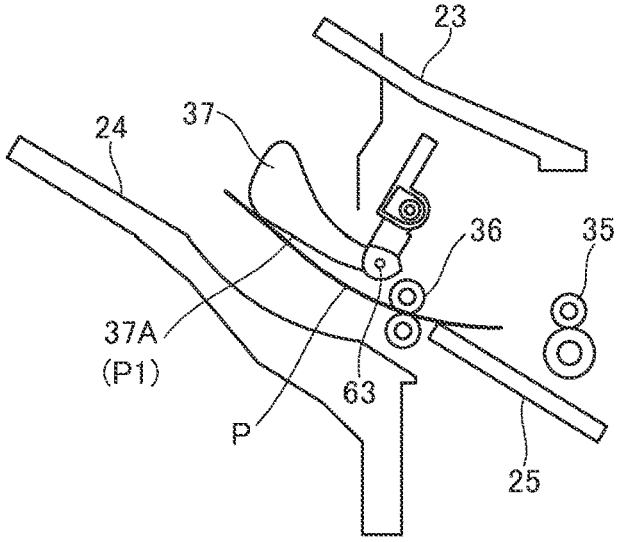
Figure 3C:
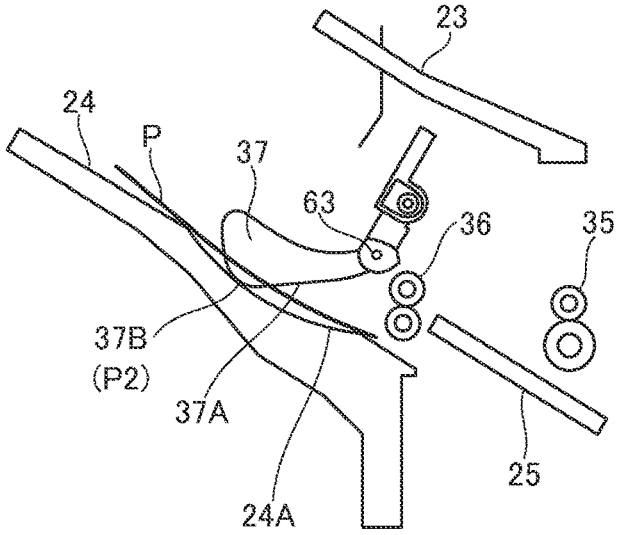
Figure 4A:
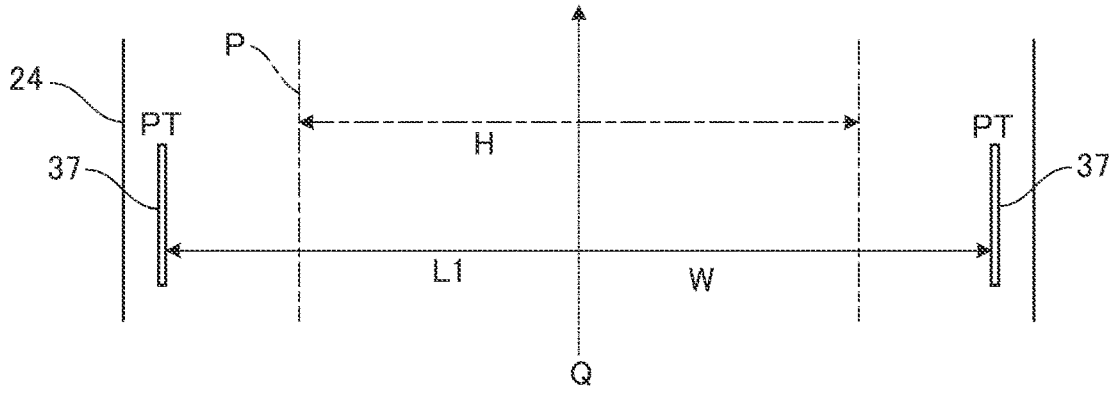
FIGS. 4A to 4C are plan views showing sliding movements of a pair of side end cursors in a direction toward and away from each other.
Figure 4B:
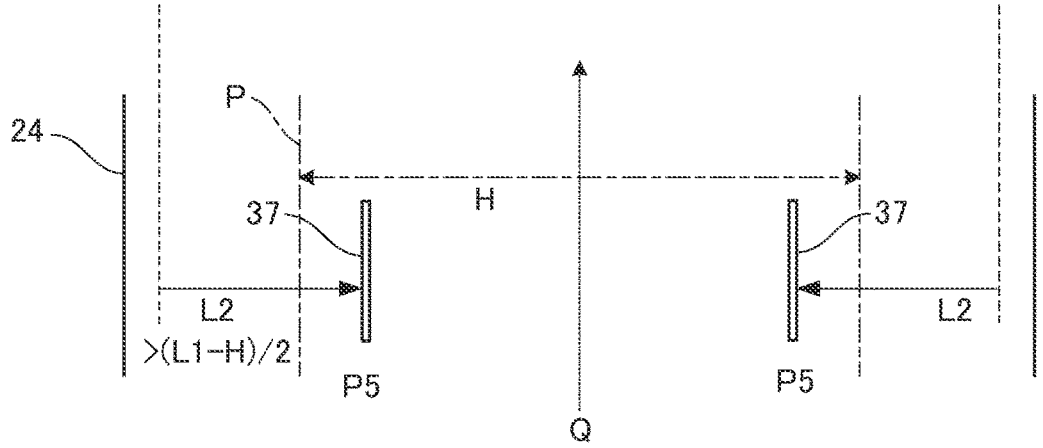
Figure 4C:
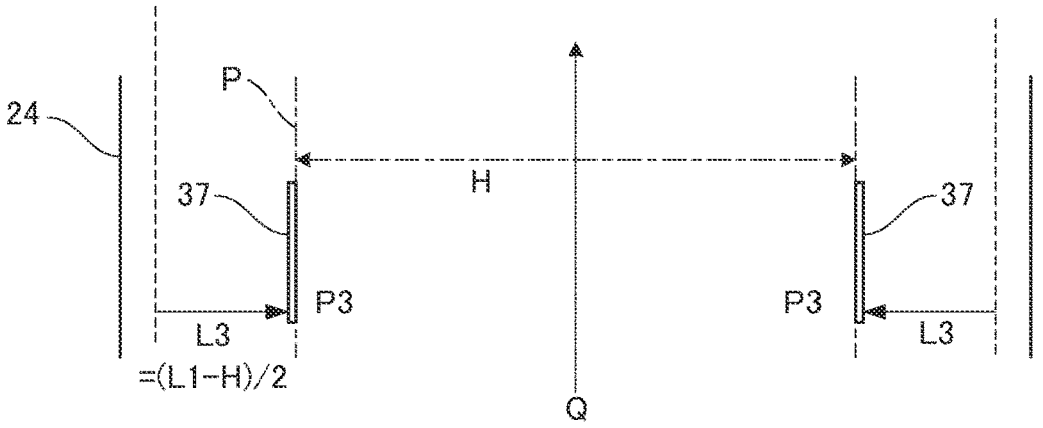

FIGS. 3A to 3C are side views showing pivoting poses of each side end cursor 37 in the direction toward and away from the main tray 24. FIGS. 4A to 4C are plan views schematically showing sliding movements of the pair of side end cursors 37 in the direction toward and away from each other.

As shown in FIGS. 3A to 3C, an end of each of the side end cursors 37 in the direction of ejection is mounted to and supported by a pin 63 extending in the width direction. The side end cursors 37 are pivotable toward and away from the main tray 24 around the axes of the respective pins 63. As shown in FIGS. 4A to 4C, the side end cursors 37 are capable of sliding movement toward and away from each other in the width direction W orthogonal to the direction Q of ejection of the recording paper sheet P.

By pivoting of each of the side end cursors 37, the side end cursors 37 assume: (i) a predetermined retracted pose in which, as shown in FIG. 3A, each of the side end cursors 37 has moved to a respective ready position P0 and is retracted and housed within the main body of the sheet post-processing apparatus 20; (ii) a pose in which, as shown in FIG. 3B, each of the side end cursors 37 has moved to a respective predetermined first position P1 where an edge 37A of the side end cursor 37 facing the main tray 24 (a lower edge thereof in FIG. 3B) is located away from the main tray 24; or (iii) a pose in which, as shown in FIG. 3C, each of the side end cursors 37 has moved to a respective predetermined second position P2 where the edge 37A thereof comes close to or into contact with the main tray 24.

By sliding movement of the side end cursors 37 toward or away from each other in the width direction, the side end cursors 37 move to: (a) their respective predetermined ready positions PT located farthest away from each other as shown in FIG. 4A; (b) their respective predetermined holding positions P5 where, as shown in FIG. 4B, the side end cursors 37 are located inwardly of the recording paper sheet P in the width direction; or (c) their respective predetermined abutment positions P3 where, as shown in FIG. 4C, the side end cursors 37 abut against respective ends (side ends) of the recording paper sheet P in the width direction.

In a state where the side end cursors 37 have moved to their ready positions PT as shown in FIG. 4A, as shown in FIG. 3A, each of the side end cursors 37 is pivoted to the respective ready position P0 and retracted and housed within the sheet post-processing apparatus 20. In this case, the space above the main tray 24 is left open by the absence of the side end cursors 37. Therefore, the side end cursors 37 are kept from coming into contact with a recording paper sheet P being ejected from the ejection roller 36.

In a state where the side end cursors 37 have moved to their holding positions P5 located inwardly of a region corresponding to the width of a recording paper sheet P as shown in FIG. 4B, as shown in FIG. 3B, each of the side end cursors 37 stays positioned at the respective first position P1 where the lower edge 37A of the side end cursor 37 is located away from the main tray 24. The first position P1 is assumed to be a position where the respective lower edge 37A of each of the side end cursors 37 comes into contact with a recording paper sheet P being ejected by the ejection roller 36.

The recording paper sheet P is ejected to the main tray 24 while sliding under the edge 37A and, thus, a curl or deflection of the recording paper sheet P is corrected. Hereinafter, the control to move the side end cursors 37 to their respective first positions P1 and holding positions P5 as shown in FIGS. 3B and 4B is referred to as a first mode. Specifically, the first positions P1 are positions where the respective edges 37A of the side end cursors 37 facing the main tray 24 are located above and away from the main tray 24 and come into contact with a recording paper sheet P being ejected by the ejection roller 36.

Then, as shown in FIG. 4A, the side end cursors 37 move to their respective ready positions PT farthest away from each other. From this state, as shown in FIG. 3C, the respective lower edge 37A of each of the side end cursors 37 moves toward the main tray 24 and, eventually, the side end cursors 37 move to the respective second positions P2 where respective curved convex portions 37B forming portions of the respective edges 37A come close to or into contact with associated curved concave surfaces 24A of the main tray 24.

From this state, the pair of side end cursors 37 further move toward each other in the width direction and, eventually, as shown in FIG. 4C, move to the respective abutment positions P3 where the pair of side end cursors 37 abut against the respective side ends of the recording paper sheet P. Thus, the recording paper sheets P loaded on the main tray 24 are restricted and aligned in terms of positions of their side ends in the width direction. Hereinafter, the control to move the side end cursors 37 to the respective ready positions PT, second positions P2, and abutment positions P3 as shown in FIGS. 4A, 3C, and 4C is referred to as a second mode.

As thus far described, the side end cursors 37 have: a function (based on the first mode) to correct a curl or deflection of a recording paper sheet P and allow the recording paper sheet P to be ejected to the main tray 24; and a function (based on the second mode) to restrict and align the side ends of recording paper sheets P loaded on the main tray 24.

Figure 5:
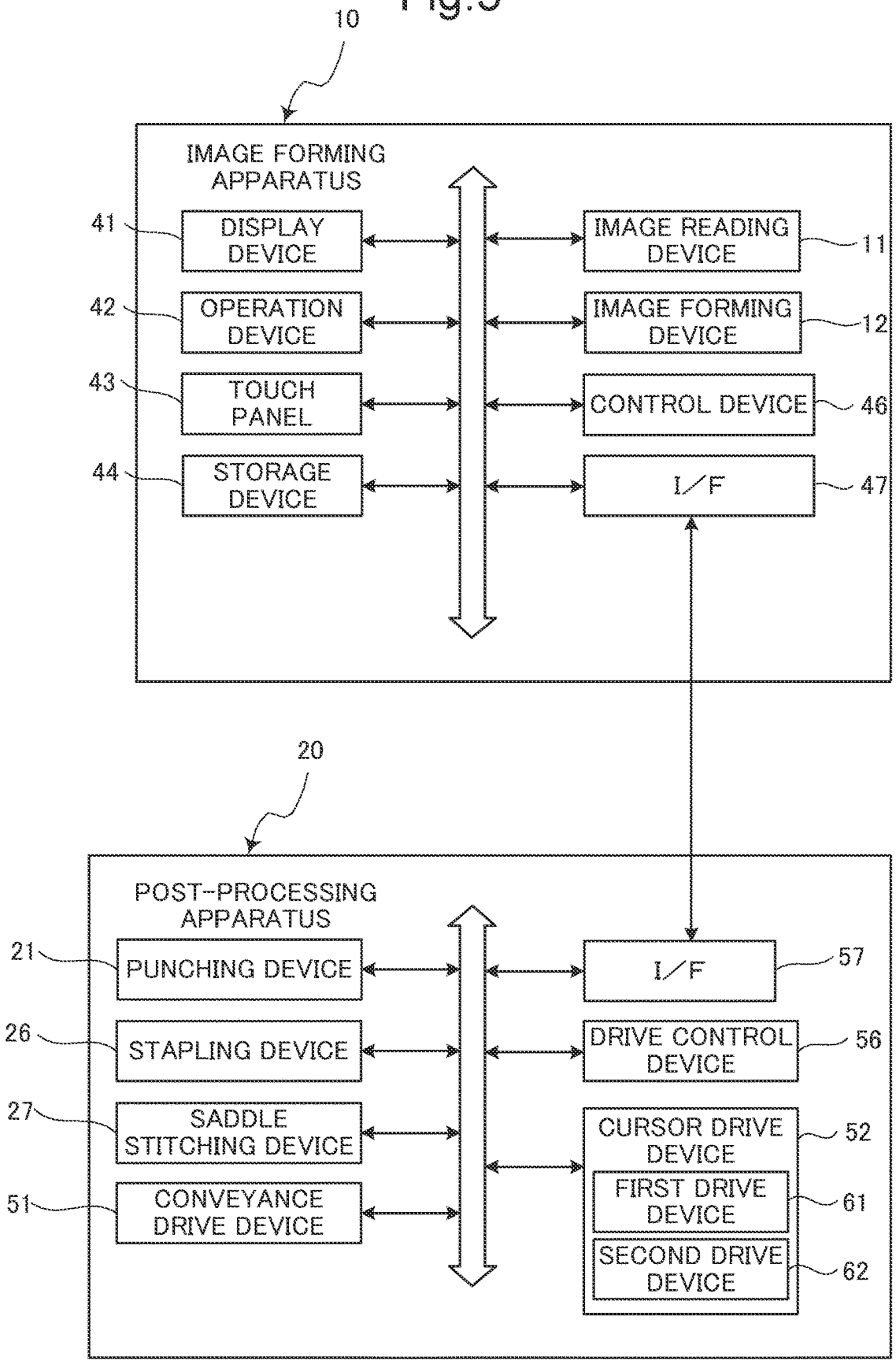
FIG. 5 is a functional block diagram showing essential internal configurations of the image forming apparatus and the sheet post-processing apparatus.

Next, a description will be given of configurations related to the control of the image forming apparatus 10 and the sheet post-processing apparatus 20. FIG. 5 is a functional block diagram showing essential internal configurations of the image forming apparatus 10 and the sheet post-processing apparatus 20. As shown in FIG. 5, the image forming apparatus 10 includes the image reading device 11, the image forming device 12, a display device 41, an operation device 42, a touch panel 43, a storage device 44, a control device 46, and an interface 47. These components can transmit and receive data or signals to and from each other via a bus.

The display device 41 is formed of a liquid crystal display (LCD), an organic EL display (organic light-emitting diode (OLED) display) or the like.

The operation device 42 includes physical keys, including numeric keys, an Enter key, and a Start key. The operation device 42 accepts the input of various instructions associated with user's operations on the numeric keys or other keys.

The touch panel 43 is disposed over the screen of the display device 41. The touch panel 43 is a touch panel of a resistive film system, a capacitance system or any other system. The touch panel 43 detects a touch on the touch panel 43 with a user's finger or the like, together with a point of the touch, and outputs a detection signal indicating the coordinate of the point of touch to the control device 46.

The storage device 44 is a large storage device, such as an SSD (solid state drive) or an HDD (hard disk drive). The storage device 44 holds various types of application programs and various types of data.

The control device 46 is made up of a processor, a RAM (random access memory), a ROM (read only memory), and so on. The processor is, for example, a CPU (central processing unit), an ASIC (application specific integrated circuit) or an MPU (micro processing unit). The control device 46 executes a control program stored in the above ROM or the storage device 44 to function as a processor that executes various types of processing necessary for image formation by the image forming apparatus 10.

The control device 46 is connected to the image reading device 11, the image forming device 12, the display device 41, the operation device 42, the touch panel 43, the storage device 44, the interface 47, and so on and performs operation control on each of these components and signal or data transfer to and from each of the components.

The control device 46 controls the display operation of the display device 41. The control device 46 accepts an operation instruction input by a user, based on a detection signal output from the touch panel 43 or a user's operation on the physical keys of the operation device 42. For example, the control device 46 accepts through the touch panel 43 a user's touch gesture on a GUI (graphical user interface) or the like being displayed on the screen of the display device 41.

The sheet post-processing apparatus 20 includes the punching device 21, the stapling device 26, the saddle stitching device 27, a conveyance drive device 51, a cursor drive device 52, a drive control device 56, and an interface 57. These components can transmit and receive data or signals to and from each other via a bus.

The conveyance drive device 51 includes a motor, an actuator, a clutch, and so on for use in rotating the conveyance roller 21, the relay roller 35, and the ejection rollers 34, 36 and changing the positions of the diverting fingers 31, 32, and 33. The conveyance drive device 51 allows a recording paper sheet P conveyed from the image forming apparatus 10 to be ejected directly to the sub-tray 23 or the main tray 24, or allows a plurality of recording paper sheets P to be conveyed to the processing tray 25 and then allows the plurality of post-processed recording paper sheets P to be ejected from the processing tray 25 to the main tray 24, or allows a plurality of recording paper sheets P to be sequentially conveyed to the saddle stitching device 27.

The cursor drive device 52 includes: first drive devices 61 serving as drive mechanisms that each pivot one of the side end cursors 37 toward and away from the main tray 24 around the axis of the pin 63; and a second drive device 62 serving as a drive mechanism that slidingly moves the side end cursors 37 toward and away from each other in the width direction orthogonal to the direction of ejection of the recording paper sheet P. The first drive devices 61 are provided, one for each of the side end cursors 37.

The drive control device 56 is formed of a processor, a RAM, a ROM, and so on. The drive control device 56 is an example of the control device defined in CLAIMS.

The control device 46 of the image forming apparatus 10 and the drive control device 56 of the sheet post-processing apparatus 20 transfer data or signals to and from each other through their respective interfaces 47 and 57. For example, the control device 46 of the image forming apparatus 10 outputs a control signal indicating post-processing of the sheet post-processing apparatus 20 to the drive control device 56 of the sheet post-processing apparatus 20. The drive control device 56 of the sheet post-processing apparatus 20 controls, according to the control signal, the drives of the stapling device 26, the saddle stitching device 27, the conveyance drive device 51, the cursor drive device 52, and so on.

For example, assume that, in the image formation system Sy, the image forming apparatus 10 reads the images of a plurality of original document sheets M and records the images on respective recording paper sheets P and the sheet post-processing apparatus 20 ejects each of the recording paper sheets P directly to the main tray 24 to allow the recording paper sheets P to be loaded on the main tray 24. In this case, based on a user's gesture on the GUI being displayed on the screen of the display device 41, the control device 46 of the image forming apparatus 10 accepts through the touch panel 43 a direct ejection instruction indicating processing for ejecting recording paper sheets P directly to the main tray 24. The user places a plurality of original document sheets M in the image reading device 11 and inputs an instruction to execute a copy job by a user's operation on the Start key of the operation device 42. The control device 46 accepts this instruction to execute a copy job.

According to the direct ejection instruction and the instruction to execute a copy job, the control device 46 outputs a control signal indicating the direct ejection processing for direct ejection to the main tray 24 and the size of recording paper sheet P through the interface 47 to the sheet post-processing apparatus 20. Meanwhile, the control device 46 allows the image reading device 11 to sequentially read the images of the original document sheets M, allows the image forming device 12 to form the images of the original document sheets M on respective recording paper sheets P, and allows the conveyance roller 19 to sequentially convey the recording paper sheets P with images formed thereon to the sheet post-processing apparatus 20.

The drive control device 56 of the sheet post-processing apparatus 20 receives the control signal indicating the direct ejection processing for direct ejection to the main tray 24 and the size of recording paper sheet P through the interface 57. The drive control device 56 controls the conveyance drive device 51 based on the control signal to allow the recording paper sheets P conveyed from the image forming apparatus 10 to be sequentially received and allow them to be ejected to and loaded on the main tray 24.

In doing so, the drive control device 56 controls the first drive devices 61 and the second drive device 62 of the cursor drive device 52 to allow the edges 37A of the side end cursors 37 to move to the respective first positions P1 located away from the main tray 24. Subsequently, the drive control device 56 allows the side end cursors 37 to move to the respective holding positions P5 located inwardly of the recording paper sheet P in the width direction. In this state, the drive control device 56 allows the recording paper sheet P to be ejected to the main tray 24. In other words, the drive control device 56 performs the control in the first mode. Thus, the recording paper sheet P is ejected while sliding under the edges 37A of the side end cursors 37. As a result, a curl or deflection of the recording paper sheet P is corrected.

When all the recording paper sheets P are ejected to the main tray 24, the drive control device 56 allows the side end cursors 37 to temporarily move to the respective ready positions PT located outwardly of the region corresponding to the width of the recording paper sheet P. In this state, the drive control device 56 allows the side end cursors 37 to move to the respective second positions P2 where the edges 37A thereof come close to or into contact with the main tray 24. Subsequently, the drive control device 56 allows the side end cursors 37 to move toward each other and eventually to the respective abutment positions P3. In other words, the drive control device 56 performs the control in the second mode. Thus, the recording paper sheets P loaded on the main tray 24 are restricted and aligned in terms of positions of their side ends in the width direction by the pair of side end cursors 37. The drive control device 56 successively performs the control in the first mode and the control in the second mode.

Next, a detailed description will be given of the structure of each of the side end cursors 37 and each of the first drive devices 61 and the second drive device 62 of the cursor drive device 52 with reference to FIGS. 6 to 10.

Figure 6:
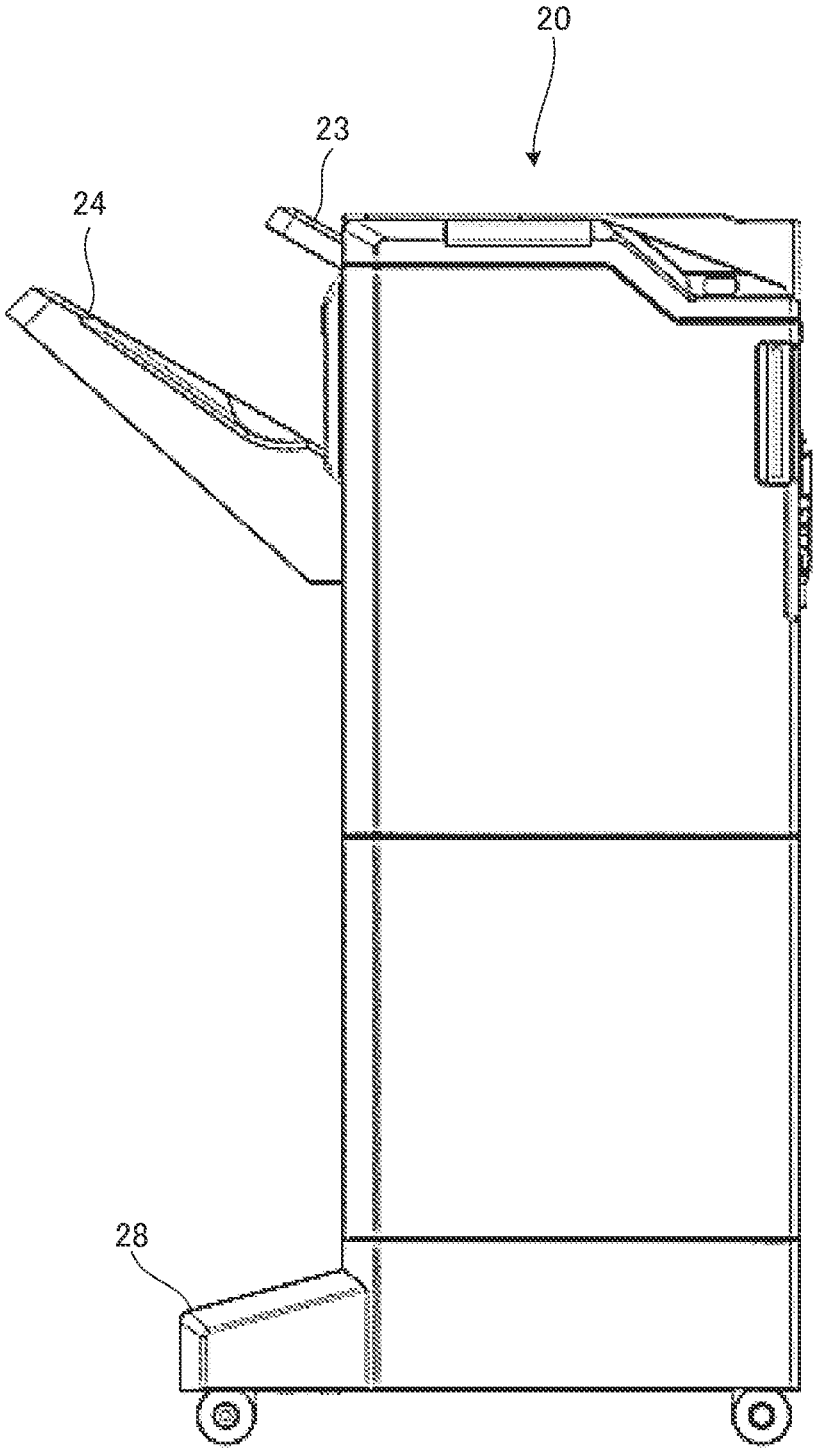
FIG. 6 is a side view showing the sheet post-processing apparatus.

FIG. 6 is a side view showing the sheet post-processing apparatus 20. As shown in FIG. 6, an upper portion of the sheet post-processing apparatus 20 is provided with the sub-tray 23 and the main tray 24. A lower portion of the sheet post-processing 20 is provided with the output tray 28.

Figure 7A:
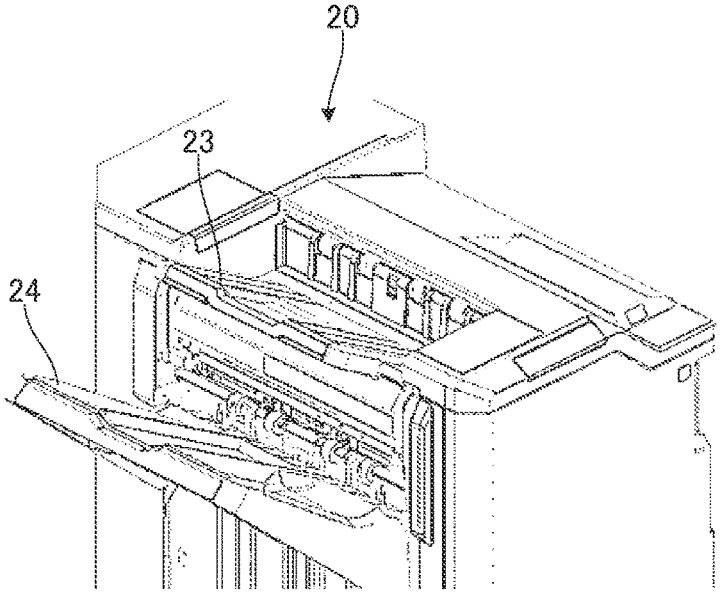
FIG. 7A is a view showing a state where the side end cursors are retracted and housed within the sheet post-processing apparatus.
Figure 7B:
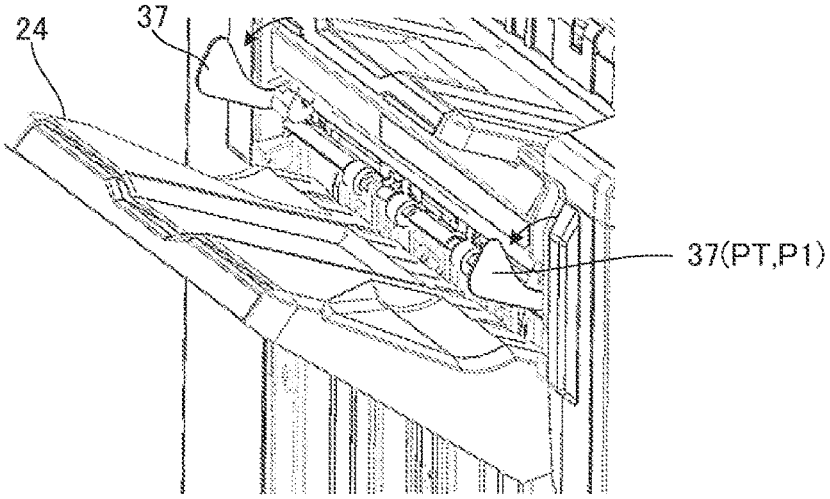
FIG. 7B is a view showing a state where the side end cursors move to respective ready-to-slide positions and are positioned at respective first positions.
Figure 7C:
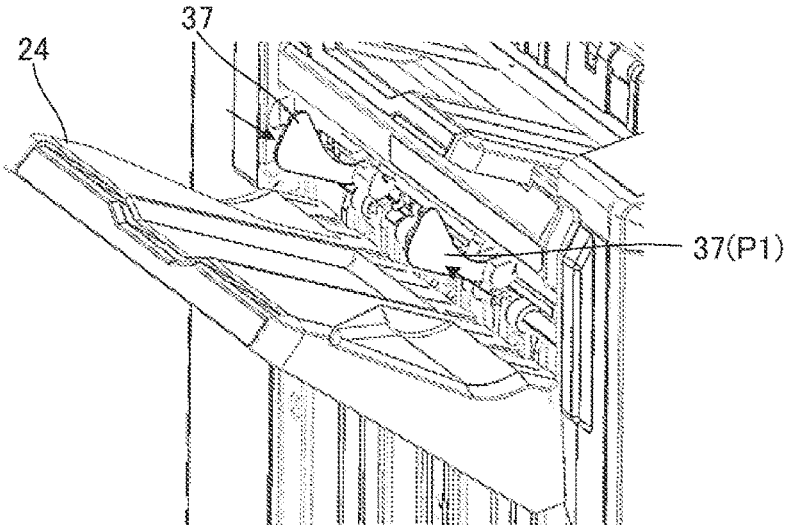
FIG. 7C is a view showing a state where the side end cursors are positioned inwardly of a region corresponding to the width of a recording paper sheet and positioned at the first positions.

FIGS. 7A to 7C are perspective views showing the main tray 24 when viewed from obliquely above the main tray 24 and the downstream side thereof in the direction of ejection of a recording paper sheet P. FIG. 7A is a view showing a state where the side end cursors 37 have moved to the respective ready positions PT and are retracted and housed within the sheet post-processing apparatus 20 (the same state as in FIGS. 3A and 4A). FIG. 7B is a view showing a state where the side end cursors 37 are at the respective ready positions PT and are positioned at the respective first positions P1 where the respective lower edges 37A of the side end cursors 37 are located away from the main tray 24 (the same state as in FIGS. 3B and 4A). Furthermore, FIG. 7C is a view showing a state where the side end cursors 37 are positioned inwardly of the region corresponding to the width of a recording paper sheet P and positioned at the respective first positions P1 where the respective lower edges 37A of the side end cursors 37 are located away from the main tray 24 (the same state as in FIGS. 3B and 4B).

Figure 8:
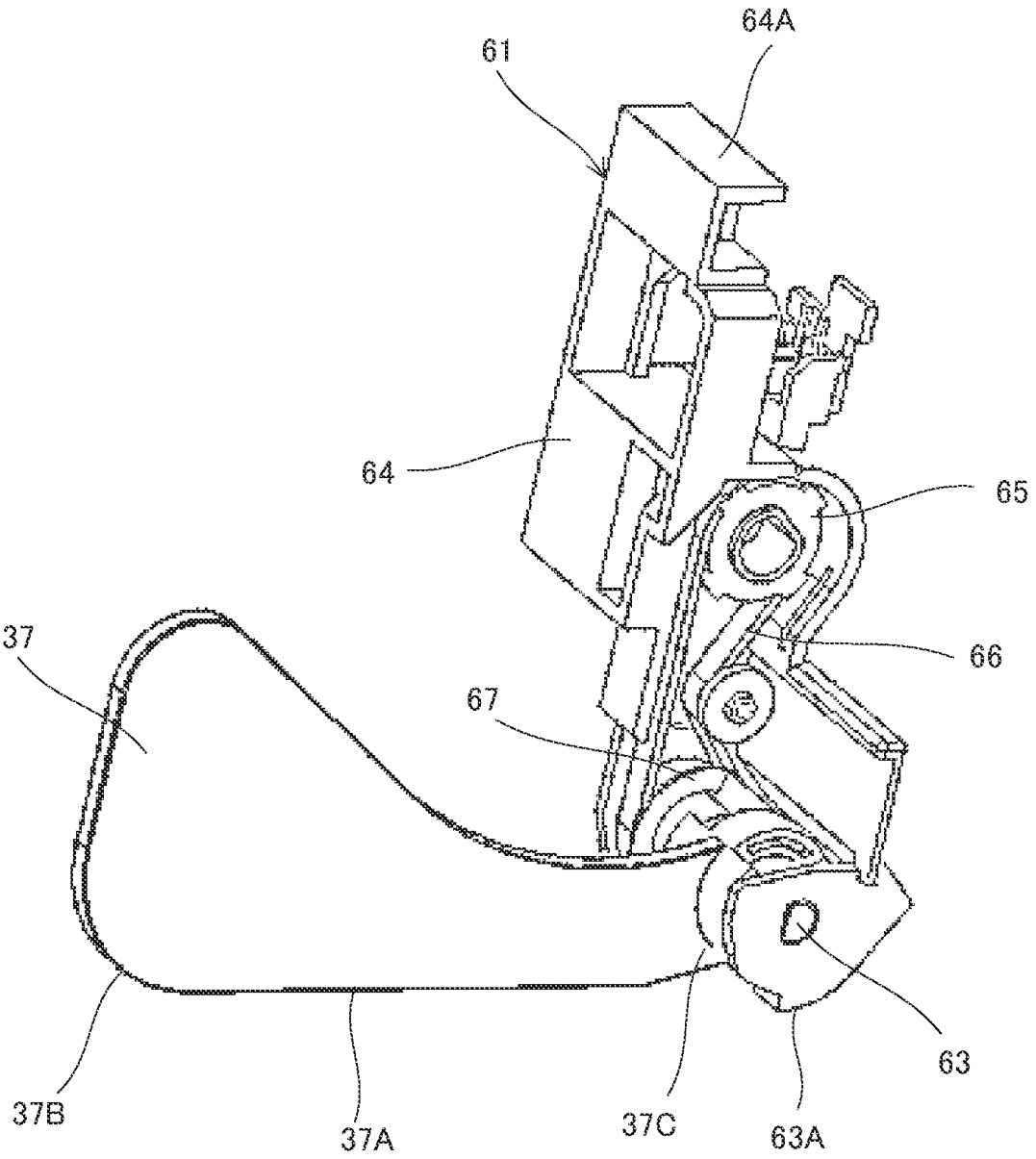
FIG. 8 is a perspective view showing a side end cursor and a first drive device.

First, a description will be given of the structures of the side end cursors 37 and the first drive devices 61. FIG. 8 is a perspective view showing a side end cursor 37 and a first drive device 61. As shown in FIG. 8, an end 37C of each of the side end cursors 37 in the direction of ejection is fixedly supported by the associated pin 63 to allow the side end cursor 37 to rotate simultaneously with the pin 63. A body 64 of the first drive device 61 contains, for example, a stepping motor. A rotational drive force of this stepping motor is transmitted via a pulley 65, a belt 66, and a pulley 67 to the pin 63 and the pin 63 thus rotates together with the side end cursor 37. The first drive devices 61 are provided, one for each of the side end cursors 37. In other words, the side end cursors 37 are mounted to separate pins 63.

The drive control device 56 controls the direction of rotation and angle of rotation of the stepping motor of the respective first drive device 61 provided for each of the side end cursors 37 to move, based on a cursor-present/cursor-absent signal output by a sensor (for example, an optical sensor) contained within the sheet post-processing apparatus 20 and capable of detecting the ready position PO (an example of the retracted position) of the associated side end cursor 37, the side end cursors 37 to the respective ready positions PO (for example, by stopping the movement of the side end cursors 37 upon receipt of the respective cursor-present signals). As shown in FIGS. 3A and 3B, the drive control device 56 pivots each of the side end cursors 37 a certain angle counterclockwise in FIGS. 3A and 3B from the respective ready position PO, thus moves the side end cursors 37 to the respective first positions P1, and positions them at the first positions P1.

The drive control device 56 controls the direction of rotation and angle of rotation of the stepping motor of the respective first drive device 61 provided for each of the side end cursors 37 to pivot, as shown in FIGS. 3B and 3C, each of the side end cursors 37 another certain angle counterclockwise in FIGS. 3B and 3C from the respective first position P1 and thus move the side end cursors 37 to the respective second positions P2.

The drive control device 56 controls the direction of rotation and angle of rotation of the stepping motor of the respective first drive device 61 provided for each of the side end cursors 37 to pivot the side end cursors 37 clockwise (shown in FIG. 3) from the respective first positions P1 or the respective second positions P2 and thus, in the same manner as described above, move the side end cursors 37 to the respective ready positions PO and stop them at the ready positions PO based on respective cursor-present/cursor-absent signals output by the sensors each capable of detecting the ready position PO of the associated side end cursor 37.

Figure 9:
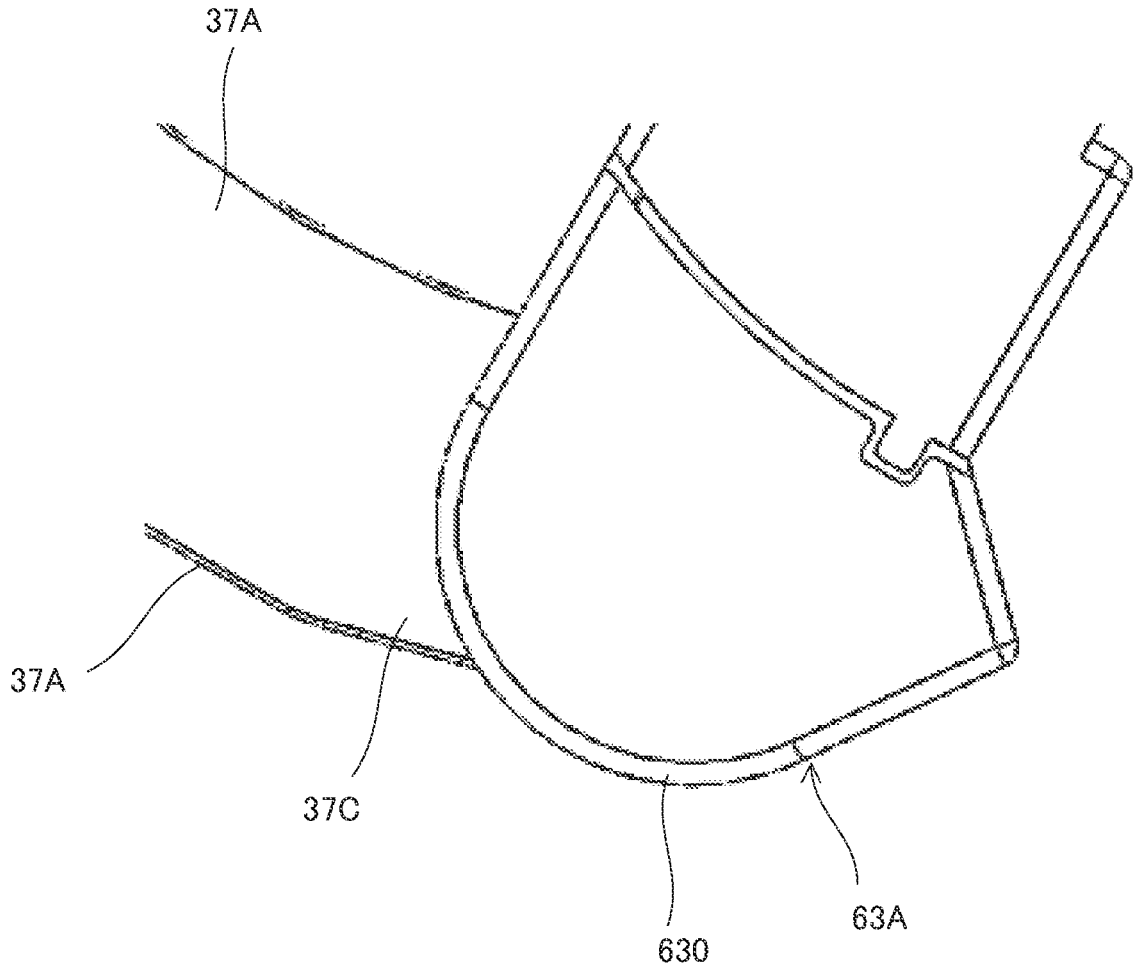
FIG. 9 is a side view showing in magnification a cover for a pin supporting an end of each of the side end cursors.

FIG. 9 is a side view showing in magnification a cover for the pin 63 supporting one end 37C of each of the side end cursors 37. As shown in FIG. 9, a cover 63A is attached to the respective pin 63 for each of the side end cursors 37. The cover 63A has a peripheral surface portion 630. The peripheral surface portion 630 extends toward the main tray 24 (downward) beyond the one end 37C of the side end cursor 37 to a location of contact with a recording paper sheet P ejected by the ejection roller 36 during the control in the first mode and has a smoothly curved surface.

As shown in FIG. 3B, the leading end of a recording paper sheet P being ejected from the ejection roller 36 toward the main tray 24 first abuts against the peripheral surface portions 630 of the covers 63A and is thus guided toward the main tray 24 with respect to the edges 37A of the side end cursors 37 (i.e., guided downwardly of the edges 37A). Thus, the leading end of the recording paper sheet P, even if deflecting, is reduced in friction upon contact with the edges 37A of the side end cursors 37. Therefore, the edges 37A hold down the recording paper sheet P from above to suppress the deflection or the like of the recording paper sheet P, but do not interfere with the ejection of the recording paper sheet P. As a result, the occurrence of a jam of the recording paper sheet P during ejection can be prevented.

Figure 10:
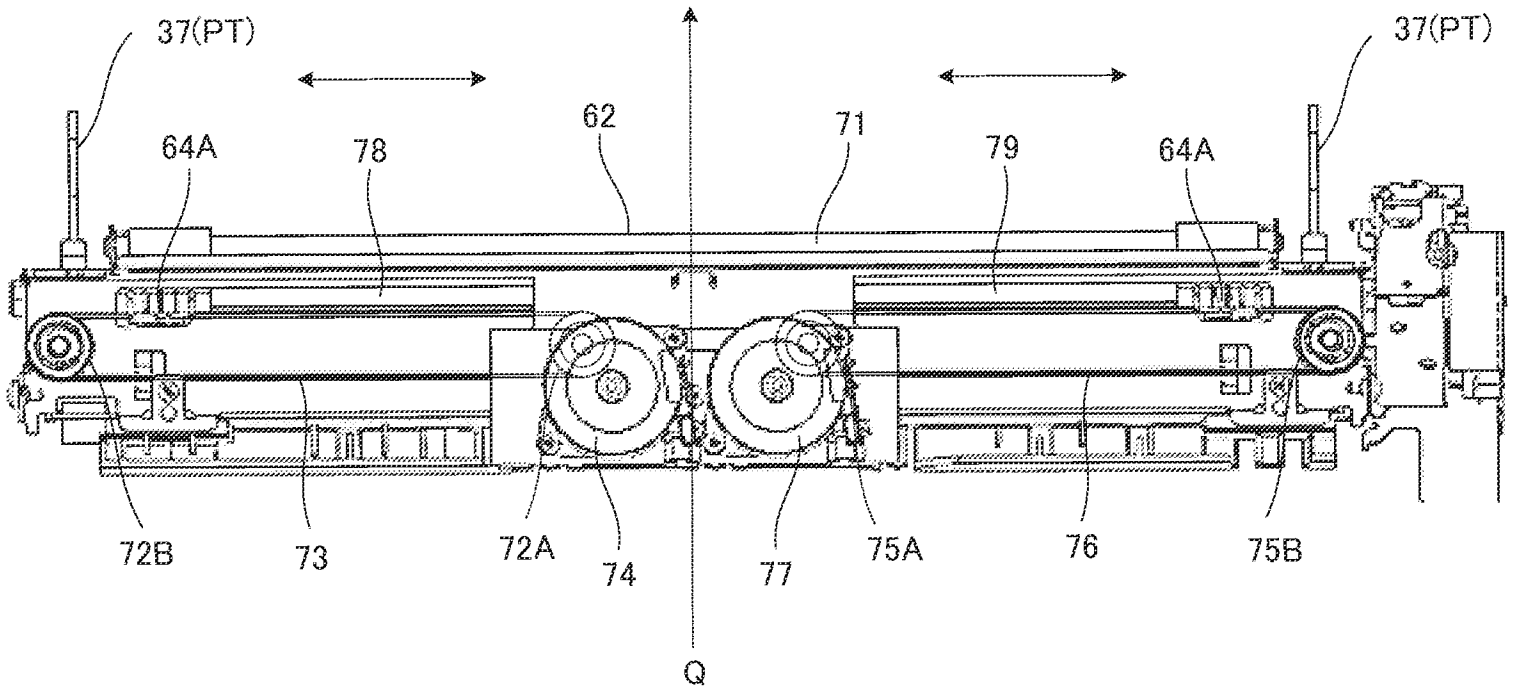
FIG. 10 is a plan view showing the side end cursors and a second drive device.

Next, a description will be given of the structures of the side end cursors 37 and the second drive device 62. FIG. 10 is a plan view showing the side end cursors 37 and the second drive device 62. FIG. 10 shows a state where the side end cursors 37 are disposed on both sides of the width direction (the right-and-left direction in FIG. 10) orthogonal to the direction Q of ejection of the recording paper sheet P and have moved to the respective ready positions PT where the side end cursors 37 are located farthest away from each other.

The second drive device 62 includes a frame 71, a pair of left-side pulleys 72A, 72B freely rotatably supported on the frame 71, an endless belt 73 mounted around the pair of left-side pulleys 72A, 72B, a left-side stepping motor 74, a pair of right-side pulleys 75A, 75B freely rotatably supported on the frame 71, an endless belt 76 mounted around the pair of right-side pulleys 75A, 75B, and a right-side stepping motor 77.

When the rotation of the left-side stepping motor 74 is transmitted via a gear to one left-side pulley 72A of the pair of left-side pulleys, the one left-side pulley 72A rotates to rotate the endless belt 73 and the other left-side pulley 72B. Likewise, when the rotation of the right-side stepping motor 77 is transmitted via a gear to one right-side pulley 75A of the pair of right-side pulleys, the one right-side pulley 75A rotates to rotate the endless belt 76 and the other right-side pulley 75B.

A slit 78 is formed in a region of the frame 71 on the left side of the center of the frame 71 in the width direction to extend in the width direction and a slit 79 is likewise formed in a region of the frame 71 on the right side of the center of the frame 71 in the width direction to extend in the width direction. The body 64 (see FIG. 8) of each of the first drive devices 61 is disposed inwardly of an associated one of the right and left side end cursors 37 (i.e., closer to the center of the frame 71 in the width direction than the associated side end cursor 37). A top end 64A of the body 64 of the first drive device 61 connected to the left side end cursor 37 is connected through the slit 78 to the endless belt 73. A top end 64A of the body 64 of the first drive device 61 connected to the right side end cursor 37 is connected through the slit 79 to the endless belt 76.

Respective guide rails for the right and left side end cursors 37 extend linearly in the width direction under the frame 71. The respective bodies 64 of the first drive devices 61 are supported by the respective guide rails slidably in the width direction along the guide rails.

When the endless belt 73 is rotated by the left-side stepping motor 74 as described above, the left side end cursor 37 connected through the body 64 of the associated first drive device 61 to the endless belt 73 follows the rotation of the endless belt 73 and thus slidingly moves to the right or left. When the endless belt 76 is rotated by the right-side stepping motor 77, the right side end cursor 37 connected through the body 64 of the associated first drive device 61 to the endless belt 76 follows the rotation of the endless belt 76 and thus slidingly moves to the right or left.

The drive control device 56 controls the direction of rotation and angle of rotation of each of the stepping motors 74, 77 of the second drive device 62 to move, based on respective cursor-present/cursor-absent signals output by sensors (for example, optical sensors) each capable of detecting the ready position PT of the associated side end cursor 37 (the ready positions PT are positions of the side end cursors 37 when located farthest away from each other), the side end cursors 37 to the respective ready positions PT (for example, by stopping the movement of the side end cursors 37 upon receipt of the respective cursor-present signals). Likewise, sensors are also provided at respective locations corresponding to the holding positions P5 and the abutment positions P3. Based on cursor-present/cursor-absent signals output by these sensors, the drive control device 56 moves the side end cursors 37 to their respective holding positions P5 or their respective abutment positions P3.

Figure 11:
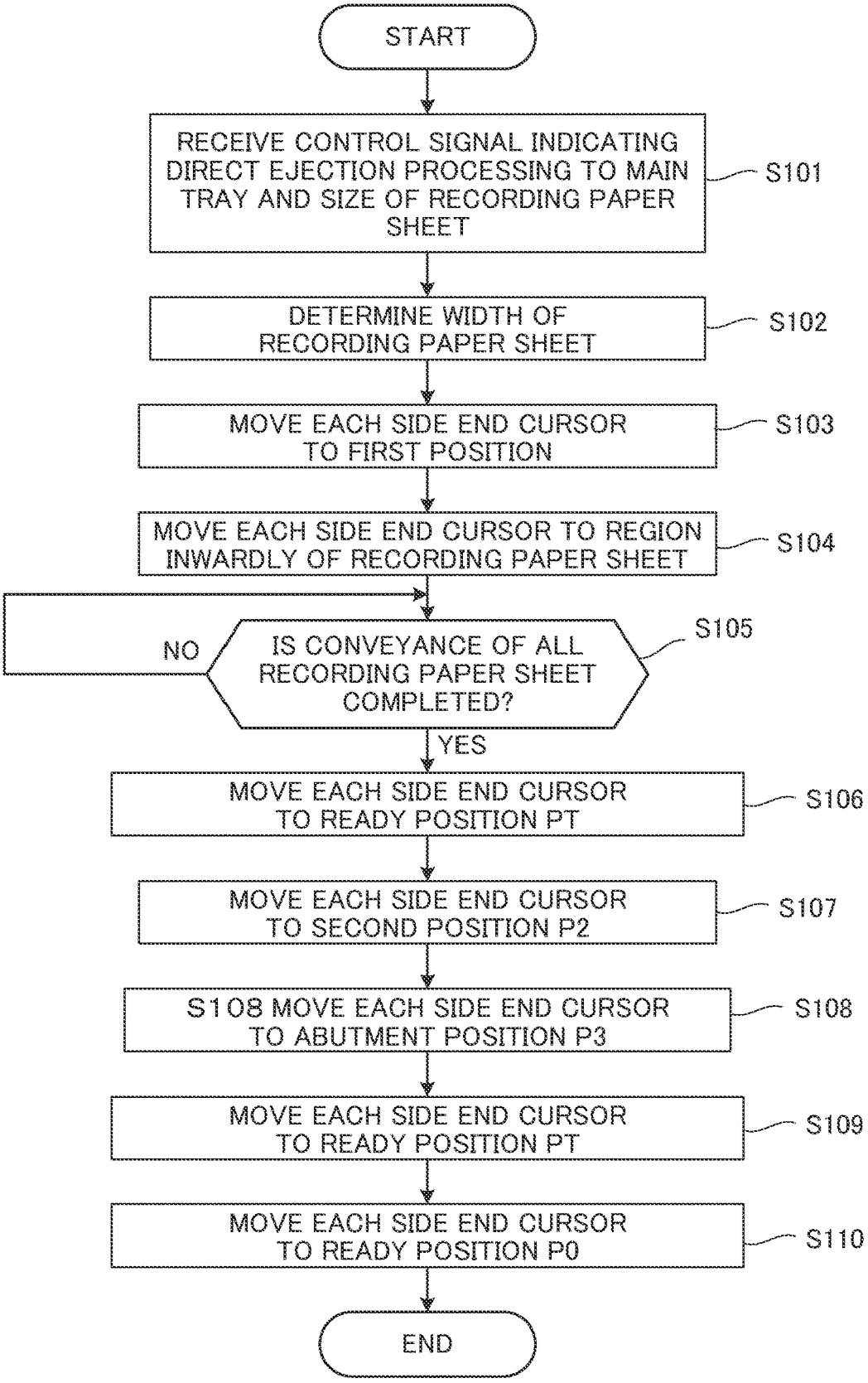
FIG. 11 is a flowchart showing the control procedure of side end cursor movement processing.

Next, a detailed description will be given of the control procedure of side end cursor movement processing for pivotal movement and sliding movement of the side end cursors 37 with reference to the flowchart shown in FIG. 11.

The control device 46 of the image forming apparatus 10 outputs a control signal indicating direct ejection processing for direct ejection to the main tray 24 and the size (length and width) of recording paper sheet P through the interface 47 to the drive control device 56 of the sheet post-processing apparatus 20. Each time the image forming device 12 forms an image on a recording paper sheet P, the control device 46 conveys the recording paper sheet P to the sheet post-processing apparatus 20.

The drive control device 56 of the sheet post-processing apparatus 20 receives the control signal indicating the direct ejection processing for direct ejection to the main tray 24 and the size (length and width) of recording paper sheet P through the interface 57 (step S101). The drive control device 56 determines the width of recording paper sheet P indicated by the control signal (step S102).

In step S102, the drive control device 56 sets, according to the width of recording paper sheet P, the holding positions P5 and the abutment positions P3 in the width direction. Specifically, the drive control device 56 sets optimal holding positions P5 and abutment positions P3 different depending on the width of recording paper sheet P. For example, the drive control device 56 allows a storage device, such as a ROM, included therein to previously store information indicating holding positions P5 and abutment positions P3 according to the width of recording paper sheet P.

Before determining the width of recording paper sheet P, the drive control device 56 moves the side end cursors 37 to their respective ready positions PT and ready positions P0 to retract them within the sheet post-processing apparatus 20. Here, the ready positions PT in the width direction are the same regardless of the width of recording paper sheet P.

The drive control device 56 controls the direction of rotation and angle of rotation of the stepping motor of the first drive device 61 provided for each of the side end cursors 37 to pivot, as shown in FIGS. 3A and 3B, each of the side end cursors 37 a certain angle counterclockwise in FIGS. 3A and 3B and thus move the side end cursors 37 to the respective first positions P1 (step S103).

The drive control device 56 controls the direction of rotation and angle of rotation of each of the stepping motors 74, 77 of the second drive device 62 to move, as shown in FIGS. 4A and 4B, the side end cursors 37 from the respective ready positions PT, in which the side end cursors 37 are located farthest away from each other, to the respective holding positions P5 set in step S102 (step S104).

For example, assume that, as shown in FIGS. 4A and 4B, the center of the recording paper sheet P in the width direction is coincident with the center between the pair of side end cursors 37. In this case, where the distance between the respective ready positions PT of the side end cursors 37 is represented as L1, the moving distance of each of the side end cursors 37 from its ready position PT to its holding position P5 is represented as L2, and the width of the recording paper sheet P is represented as H, the moving distance L2 is (L1−H)/2. Therefore, the side end cursors 37 fall within a region located inwardly of a to-be-ejected recording paper sheet P in the width direction.

In the manner described above, the side end cursors 37 are positioned, as shown in FIG. 4B, at the holding positions P5 inwardly of the recording paper sheet P in the width direction and positioned, as shown in FIG. 3B, at the first positions P1 where the lower edges 37A of the side end cursors 37 are located away from the main tray 24.

The drive control device 56 controls, according to the received control signal indicating the direct ejection processing for direct ejection to the main tray 24, the conveyance drive device 51 to allow the recording paper sheet P conveyed from the image forming apparatus 10 to be ejected through the ejection roller 36 onto the main tray 24. In this case, as shown in FIG. 3B, the recording paper sheet P slides under the edges 37A of the side end cursors 37 positioned at the first positions P1 and is therefore ejected to the main tray 24 with a curl or deflection of the recording paper sheet P corrected. In other words, the drive control device 56 performs the control in the first mode.

Unless receiving a control signal indicating the completion of conveyance of all recording paper sheets P through the interface 57 from the control device 46 of the image forming apparatus 10 ("No" in step S105), the drive control device 56 continues the control in the first mode where the side end cursors 37 are held at their holding positions P5 and first positions P1. Therefore, each time a recording paper sheet P is conveyed from the image forming apparatus 10, the recording paper sheet P slides under the lower edges 37A of the side end cursors 37, is thus corrected in terms of curl or deflection, and is then ejected to the main tray 24 by the ejection roller 36.

When the conveyance of all the recording paper sheets P is completed, the control device 46 of the image forming apparatus 10 outputs a control signal indicating the completion of the conveyance through the interface 47 to the drive control device 56 of the sheet post-processing apparatus 20.

When receiving the control signal indicating the completion of the conveyance through the interface 57 ("Yes" in step S105), the drive control device 56 of the sheet post-processing apparatus 20 controls the direction of rotation and angle of rotation of each of the stepping motors 74, 77 of the second drive device 62 to move the side end cursors 37 to the respective ready positions PT where the side end cursors are located farthest away from each other (step S106) and position the side end cursors 37 at respective locations outwardly of the recording paper sheet P in the width direction.

The drive control device 56 controls the direction of rotation and angle of rotation of the stepping motor of the first drive device 61 provided for each of the side end cursors 37 to pivot, as shown in FIGS. 3B and 3C, each of the side end cursors 37 another certain angle counterclockwise in FIGS. 3B and 3C from the respective first position P1 and thus move the side end cursors 37 to the respective second positions P2 (step S107). Thus, the lower edges 37A of the side end cursors 37 move toward the main tray 24 and, eventually, the curved convex portions 37B forming portions of the respective edges 37A come close to or into contact with the associated curved concave surfaces 24A of the main tray 24.

The drive control device 56 controls the direction of rotation and angle of rotation of each of the stepping motors 74, 77 of the second drive device 62 to move the side end cursors 37 toward each other and eventually to the respective abutment positions P3 (step S108). For example, assume that, as shown in FIGS. 4A and 4C, the center of the recording paper sheet P in the width direction is coincident with the center between the pair of side end cursors 37. In this case, where the distance between the respective ready positions PT of the side end cursors 37 is represented as L1, the moving distance of each of the side end cursors 37 from its ready position PT to its abutment position P3 is represented as L3, and the width of the recording paper sheet P is represented as H, the moving distance L3 is (L1−H)/2. Therefore, the positions of the side ends of the recording paper sheets P are restricted and aligned. In other words, after the control in the first mode, the drive control device 56 successively performs the control in the second mode.

The drive control device 56 controls the direction of rotation and angle of rotation of each of the stepping motors 74, 77 of the second drive device 62 to move the side end cursors 37 to the respective ready positions PT where the side end cursors 37 are located farthest away from each other (step S109). In this state, the drive control device 56 controls the direction of rotation and angle of rotation of the stepping motor of the first drive device 61 provided for each of the side end cursors 37 to pivot each of the side end cursors 37 clockwise (shown in FIG. 3) from the respective second position P2, move the side end cursor 37 to the respective ready positions PO, and stop them at the ready positions PO based on respective outputs detected by the sensors each capable of detecting the ready position PO of the associated side end cursor 37 (step S110). Thus, the side end cursors 37 are retracted again within the sheet post-processing apparatus 20.

Generally, it is preferred that a tray is loaded with a plurality of recording paper sheets in alignment with each other. To accomplish this, it is necessary to eject each of the recording paper sheets to the tray after correcting its curl or deflection, and even also align the plurality of recording paper sheets P loaded on the tray.

The general sheet loading device described previously aligns a plurality of sheets in the sheet width direction with a pair of jogger fences and restricts the uplift of the leading end of a sheet with an uplift restricting member. Therefore, there is a need to provide the pair of jogger fences and the uplift restricting member, which increases the number of components and complicates the structure.

Furthermore, the general post-processing device described previously is configured so that when the pair of alignment members move to the first position, they restrict the position of a sheet, and, on the other hand, when the pair of alignment members move to the second position, they correct a deflection of a sheet. Therefore, the pair of alignment members have two functions. However, the pair of alignment members are used held at one of the two positions and, therefore, only one of the two functions is performed separately from the other function. In other words, the pair of alignment members do not successively perform the restriction of sheet position and the correction of sheet deflection.

In contrast, in the above embodiment, the pair of side end cursors 37 are provided above the main tray 24 in opposed relation to each other in the width direction orthogonal to the direction of ejection of the recording paper sheet P, the side end cursors 37 are pivoted toward or away from the main tray 24 around the axes of the respective pins 63, and, furthermore, the side end cursors 37 are moved toward or away from each other in the width direction.

Thus, in the above embodiment, the first mode for correcting a curl or deflection of a recording paper sheet P and ejecting the corrected recording paper sheet P to the main tray 24 can be implemented, and, successively to the first mode, the second mode for restricting and aligning recording paper sheets P loaded on the main tray 24 can be implemented. In other words, in the above embodiment, both the correction of deflection of a recording paper sheet and the restriction of positions of recording paper sheets can be successively performed by the pair of side end cursors 37.

MODIFICATION

Figure 12:
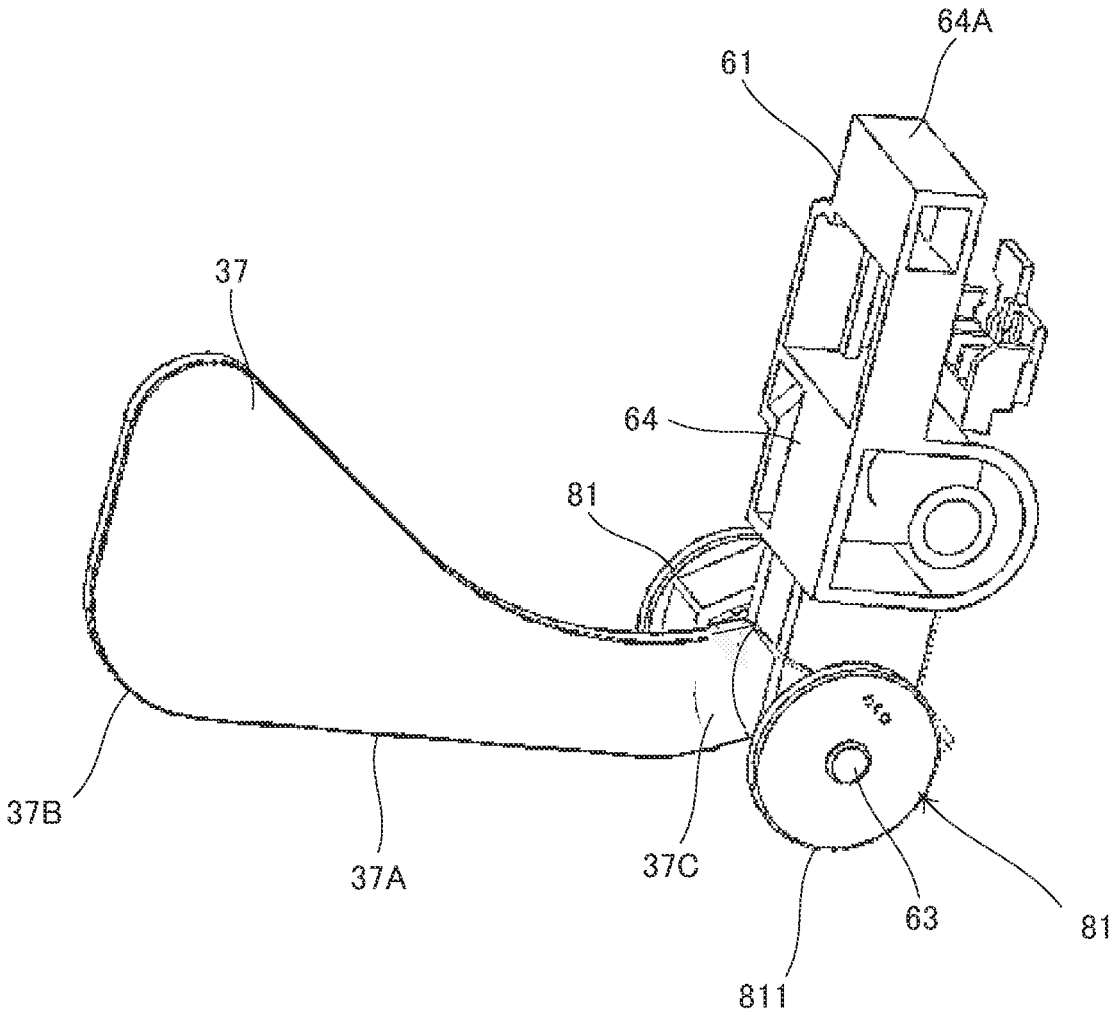
FIG. 12 is a perspective view showing a side end cursor and a first drive device according to a modification of the above embodiment.

FIG. 12 is a perspective view showing the side end cursor 37 and the first drive device 61 according to a modification of the above embodiment. In a modification of the side end cursor 37 and the first drive device 61, as shown in FIG. 12, instead of the above-described cover 63A, rollers 81 freely rotatable with respect to and around the pin 63 are provided at both ends of the respective pin 63 for each of the side end cursors 37. The rollers 81 extend toward the main tray 24 (downward) beyond the one end 37C of the associated side end cursor 37 to a location of contact with a recording paper sheet P ejected by the ejection roller 36 during the control in the first mode.

Therefore, the leading end of a recording paper sheet P being ejected from the ejection roller 36 toward the main tray 24 first abuts against ends 811 of the rollers 81 facing the main tray 24 and is thus guided toward the main tray 24 with respect to the edges 37A of the side end cursors 37 (i.e., guided downwardly of the edges 37A). Thus, the leading end of the recording paper sheet P, even if deflecting, is reduced in friction upon contact with the edges 37A of the side end cursors 37. Therefore, the edges 37A hold down the recording paper sheet P from above to suppress the deflection or the like of the recording paper sheet P, but do not interfere with the ejection of the recording paper sheet P.

Furthermore, since the rollers 81 freely rotate with respect to the associated pin 63, the friction upon contact of the recording paper sheet P with the ends 811 is smaller than that upon contact of the recording paper sheet P with the cover 63A and, therefore, the recording paper sheet P can be more smoothly guided to the edges 37A of the side end cursors 37.

Although in the above embodiment the sheet post-processing apparatus 20 is provided with the drive control device 56, the present disclosure is not limited to this embodiment. For example, the drive control device 56 may be dispensed with and the control device 46 may directly control the sheet post-processing apparatus 20.

Although in the above embodiment an image forming apparatus of an ink-jet system is taken as an example of the image forming apparatus 10, the present disclosure is not limited to this embodiment. The present disclosure is also applicable to, for example, an image forming apparatus of an electrophotographic system.

The structures, configurations, and processing of the embodiment described with reference to FIGS. 1 to 12 are merely illustrative and are not intended to limit the present disclosure to them.

While the present disclosure has been described in detail with reference to the embodiments thereof, it would be apparent to those skilled in the art the various changes and modifications may be made therein within the scope defined by the appended claims.

What is claimed is:

1. A sheet post-processing apparatus comprising:

a post-processing device that subjects a sheet to post-processing;

an ejection roller that ejects the sheet;

a tray on which a plurality of sheets ejected by the ejection roller are to be loaded;

a pair of side end cursors provided above the tray and the ejection roller pivotably toward and away from the tray and opposed to each other in a width direction of the sheet orthogonal to a direction of ejection of the sheet movably in the width direction;

a first drive device that pivots each of the side end cursors toward and away from the tray;

a second drive device that moves each of the side end cursors in the width direction; and a control device that includes a processor and controls, through the processor executing a control program, the first drive device and the second drive device, wherein the control device successively performs:

a control in a first mode to allow the first drive device to pivot each of the side end cursors away from the tray to thus move the side end cursors to respective predetermined first positions where edges of the side end cursors facing the tray are located above and away from the tray and come into contact with the sheet ejected by the ejection roller and allow the second drive device to move each of the side end cursors to respective holding positions located inwardly of the sheet in the width direction; and a control in a second mode to allow the second drive device to move each of the side end cursors in the width direction to respective predetermined lateral positions located outwardly of the sheet in the width direction, allow the first drive device to pivot each of the side end cursors toward the tray to thus move the side end cursors to respective predetermined second positions where the edges of the side end cursors facing the tray come close to or into contact with the tray, and then allow the second drive device to move each of the side end cursors from the lateral positions to respective predetermined abutment positions where the side end cursors abut against ends of the sheet in the width direction, wherein the side end cursors are mounted at respective upstream ends thereof in the direction of ejection to respective pins extending in the width direction and supported by the pins, and the first drive device rotates the pins and thus pivots the side end cursors toward and away from the tray, the sheet post-processing apparatus further comprises covers provided around the respective pins and extending downward beyond the upstream ends of the side end cursors supported by the pins to a location of contact with a sheet ejected by the ejection roller during the control in the first mode.

2. The sheet post-processing apparatus according to claim 1, further comprising rollers provided around the respective pins and extending downward beyond the upstream ends of the side end cursors supported by the pins to a location of contact with a sheet ejected by the ejection roller during the control in the first mode, the rollers being freely rotatable around the respective pins.

3. The sheet post-processing apparatus according to claim 1, wherein the control device controls the second drive device to move each of the side end cursors in the width direction to respective predetermined ready positions and controls the first drive device to pivot each of the side end cursors away from the tray to thus move the side end cursors to respective predetermined retracted positions where the side end cursors are retracted within a main body of the sheet post-processing apparatus.

4. The sheet post-processing apparatus according to claim 1, further comprising a storage device that previously stores information indicating the respective lateral positions and the respective abutment positions of the side end cursors according to a width of the sheet, wherein the control device sets, based on the information stored in the storage device, the lateral positions and the abutment positions of the side end cursors in the width direction according to the width of the sheet.

5. An image formation system comprising:

an image forming apparatus comprising an image forming device that forms an image of an original document on a sheet; and the sheet post-processing apparatus according to claim 1, wherein the sheet post-processing apparatus further comprises a conveyance roller that receives the sheet from the image forming apparatus and conveys the sheet toward the post-processing device.

6. The image formation system according to claim 5, wherein the image forming device forms the image of the original document on the sheet using ink based on an ink-jet system.

* * * * *